US005338025A

United States Patent [19]

Giovagnoli

[11] Patent Number: 5,338,025

[45] Date of Patent: Aug. 16, 1994

[54] BALL COLLECTION AND DISTRIBUTION APPARATUS FOR MULTIPLE BASEBALL PITCHING UNITS

[75] Inventor: Paul S. Giovagnoli, Kansas City, Mo.

[73] Assignee: Master Pitching Machine, Inc., Kansas City, Mo.

[21] Appl. No.: 185,568

[22] Filed: Jan. 24, 1994

[51] Int. Cl.[5] ..... A63B 69/40

[52] U.S. Cl. ..... 273/26 D; 124/78; 222/349; 222/228

[58] Field of Search ..... 273/26 R, 26 A, 201; 222/349, 350, 351, 352, 407; 198/540, 550; 124/78

[56] References Cited

U.S. PATENT DOCUMENTS

| | | | |
|---|---|---|---|
| 829,204 | 8/1906 | Hackburn et al. | 222/407 |
| 1,940,138 | 12/1933 | McAdams | 222/407 |
| 1,989,322 | 1/1935 | Leavitt | 222/407 |
| 2,649,994 | 8/1953 | Lewis et al. | 222/349 |
| 2,716,973 | 9/1955 | Desi | 124/78 |
| 3,587,938 | 6/1971 | Brown | 222/228 |
| 4,086,903 | 5/1978 | Scott | 124/78 |
| 4,203,413 | 5/1980 | Hodges | 124/78 |
| 4,254,896 | 3/1981 | Samford | 222/228 |
| 4,299,383 | 11/1981 | Yuasa | 124/78 |
| 5,022,657 | 6/1991 | Bussler et al. | 273/201 |
| 5,107,820 | 4/1992 | Salansky | 124/78 |
| 5,125,653 | 6/1992 | Kovacs | 124/78 |

*Primary Examiner*—Theatrice Brown

*Attorney, Agent, or Firm*—Hovey, Williams, Timmons & Collins

[57] ABSTRACT

An apparatus for use in collecting and distributing the balls of pitching machines includes a collection box having a plurality of outlet openings, and an agitator supported for rotation within the box. The agitator includes a radially extending, generally horizontally disposed flap positioned above the floor by a distance less than about the diameter of the balls, and the agitator is rotated to move the flap along a circular path extending directly over the openings. The flap is flexible vertically relative to the balls so that the balls roll beneath the flap as it moves over them.

11 Claims, 3 Drawing Sheets

BALL COLLECTION AND DISTRIBUTION APPARATUS FOR MULTIPLE BASEBALL PITCHING UNITS

BACKGROUND OF THE INVENTION

1. Field of the Invention

The present invention relates generally to batting cage pitching machines and, more particularly, to an apparatus for collecting and distributing baseballs, softballs or the like for use by such machines.

2. Discussion of the Prior Art

A conventional batting cage includes a plurality of batting stations and at least one pitching machine associated with each station for pitching baseballs or softballs to the station. A net or other enclosure is provided around the stations and machines for holding the balls in the batting cage, and the floor is sloped toward a collection point so that all of the balls may be collected and returned to the pitching machines.

Typically, these known batting cages are automated, allowing a batter to insert a token or coins in order to receive a preset number of pitched balls. Return of the balls to the pitching machines is achieved by providing an elevator at the collection point for lifting the balls to a basket from which they are redistributed through outlet openings to the pitching machines.

The basket in a conventional batting cage is a shallow circular assembly having a perimeter fence and outlet openings arranged in a circle immediately inside the fence. A central conical stirring member is provided within the basket and substantially fills the central area of the basket out to the openings. The stirring member presents a smooth conical upper surface, and rotates about the vertical center axis of the basket so that balls introduced to the basket roll off of the stirring member into one of the openings.

Problems arise in conventional assemblies when balls in the basket become jammed and are not delivered back to the pitching machines. Because the balls frequently used for commercial cages are dimpled plastic replicas of baseballs and softballs, the surfaces of the balls wear, becoming abraded and frayed. As a result, they sometimes stick together and bridge the outlet openings such that balls are blocked from a particular pitching machine. Because of such problems, supervision of the batting cages is necessary, adding to the cost of the system.

Further, conventional baskets are only designed for use with a single layer of balls, and become ineffective when two or more layers of balls are introduced since the balls bridge the outlet openings, interrupting distribution. A similar situation results if the basket is enlarged, since there is no structure for separating the balls from one another when several layers of balls are present.

OBJECTS AND SUMMARY OF THE INVENTION

It is an object of the present invention to provide a collection and distribution apparatus for pitching machines, wherein a means is provided for reducing or eliminating the problems experienced in conventional systems, and for permitting balls to feed unrestricted from a box within which they are collected.

It is another object of the invention to provide a collection and distribution apparatus which agitates the balls in a collection box to loosen the balls from one another for delivery to pitching machines so that all of the balls are used repeatedly and do not become stuck in the apparatus even when several layers of balls are stored in the box.

In accordance with these and other objects evident from the following description of a preferred embodiment of the invention, an apparatus for use in collecting and distributing balls includes a collection box having a floor and a plurality of outlet openings formed in the floor, a feeding means for feeding balls to the collection box, and an agitation means for agitating the balls in the box. The agitation means includes a flap positioned above the floor by a distance less than about the diameter of the balls, and a support means for supporting the flap in a generally horizontal orientation and for moving the flap along a path extending directly over the openings. The flap is flexible vertically so that when the flap engages the balls the flap rides up over the tops of the balls and rolls them toward the outlet openings.

By providing a construction in accordance with the present invention, numerous advantages are realized. For example, by moving a flap through the collection box over the outlet openings, and by positioning the flap to engage the balls on the floor of the box, an arrangement results which provides separation between the lowermost balls and other balls stacked above them so that the balls are free to drop into the outlet openings unrestricted.

Thus, as the flap moves over the outlet openings, it loosens the bottom layer of balls from any upper layers and rolls them toward the openings.

Another advantage is obtained due to the movement of the flap and support means along a path over the openings. During such action, the balls are agitated so that a constant stirring is achieved, allowing the balls to gravitate toward the openings and into the path of the flap. Such a stirring action is especially useful when several layers of balls are present in the collection box.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
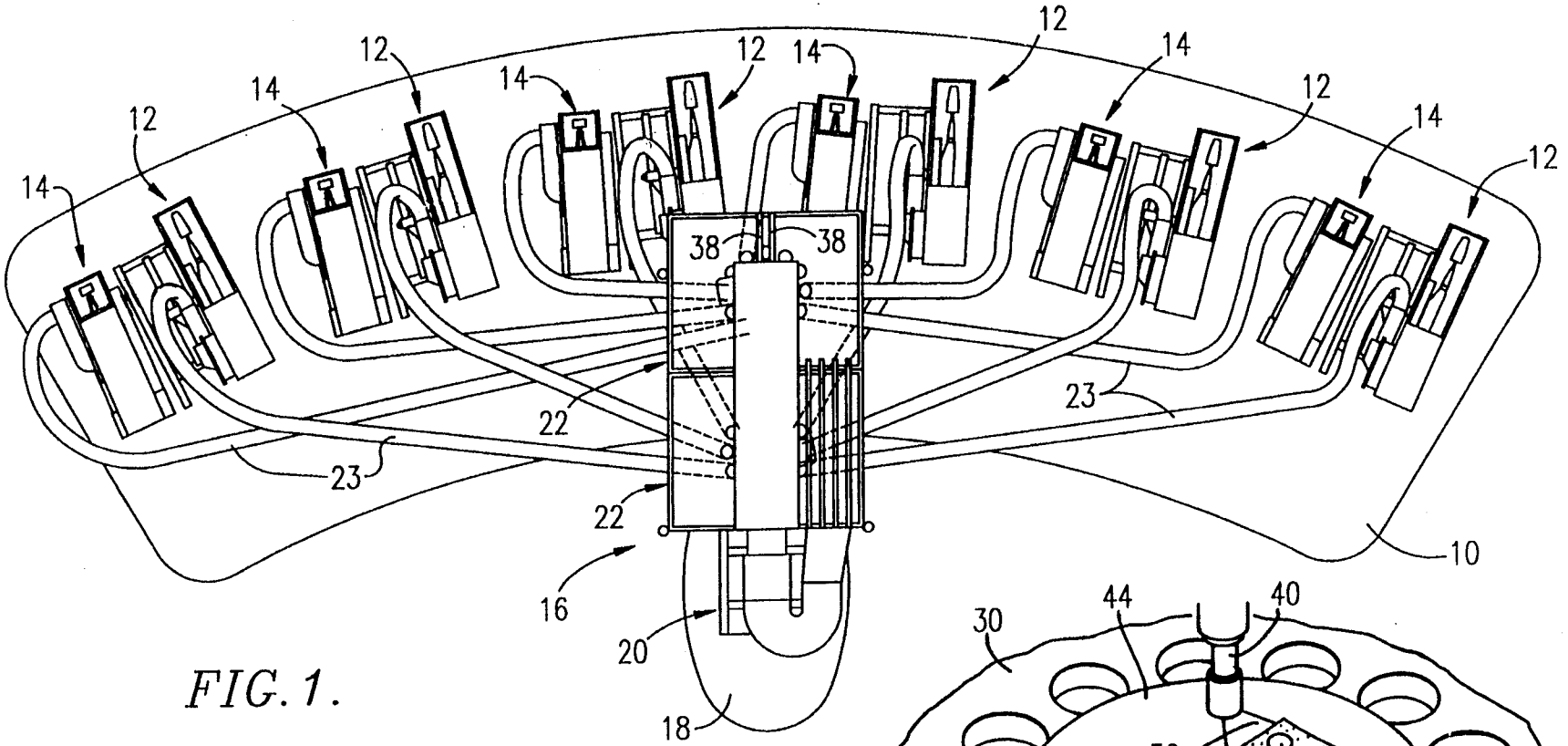
FIG. 1 is a top plan view of a batting cage pitching machine setup, including a collection and distribution apparatus constructed in accordance with the present invention.

A batting cage pitching machine setup is illustrated in FIG. 1, and includes a platform 10, a plurality of pitching machines 12, 14 supported on the platform, and a collection and distribution apparatus 16 for collecting balls within the batting cage and returning them to the pitching machines.

Typically, this setup is constructed in combination with a commercial batting cage including a plurality of batting stations and at least one pitching machine associated with each station for pitching baseballs or softballs to the station. In the embodiment illustrated in FIG. 1, twelve pitching machines are shown, each pair of which are associated with a single batting station. Preferably, one of the machines 12 of each pair is a baseball machine while the other machine 14 pitches softballs.

A net or other enclosure is provided around the stations and the machines for holding the balls in the batting cage, and the floor of the cage around the platform is sloped toward a well 18 so that all of the balls may be collected and returned to the pitching machines by the collection and distribution apparatus.

During use, a batter inserts a token or coins into an automated control box, selects the type of balls desired, and receives a preset number of pitched balls from the selected machine. After the balls are struck or swung on, they roll along the sloped floor, gravitating toward the well 18.

Collection of the balls is achieved by providing an elevator 20 for lifting the baseballs and softballs from the well to a height above the pitching machines, and a size grading floor 20 across which the balls roll after being delivered from the elevator. The floor is formed of several parallel, longitudinally extending bars that are spaced from one another by a distance slightly greater than the diameter of a baseball and smaller than the diameter of a softball. Thus, the baseballs fall through the bars into a first distribution assembly 22, and are separated from the softballs which roll along the bars into a second distribution assembly.

Distribution of the balls among the pitching machines is achieved by connecting each machine to the appropriate distribution assembly with a delivery tube 23 so that balls in the assembly fall into the tubes and gravitate through the tubes to the machines for use. As described below, a separate outlet opening is provided in the assembly for each pitching machine associated with it, and any additional openings beyond those needed may be blocked with a cup-shaped plug 24 such as that illustrated in FIG. 3.

Figure 3:
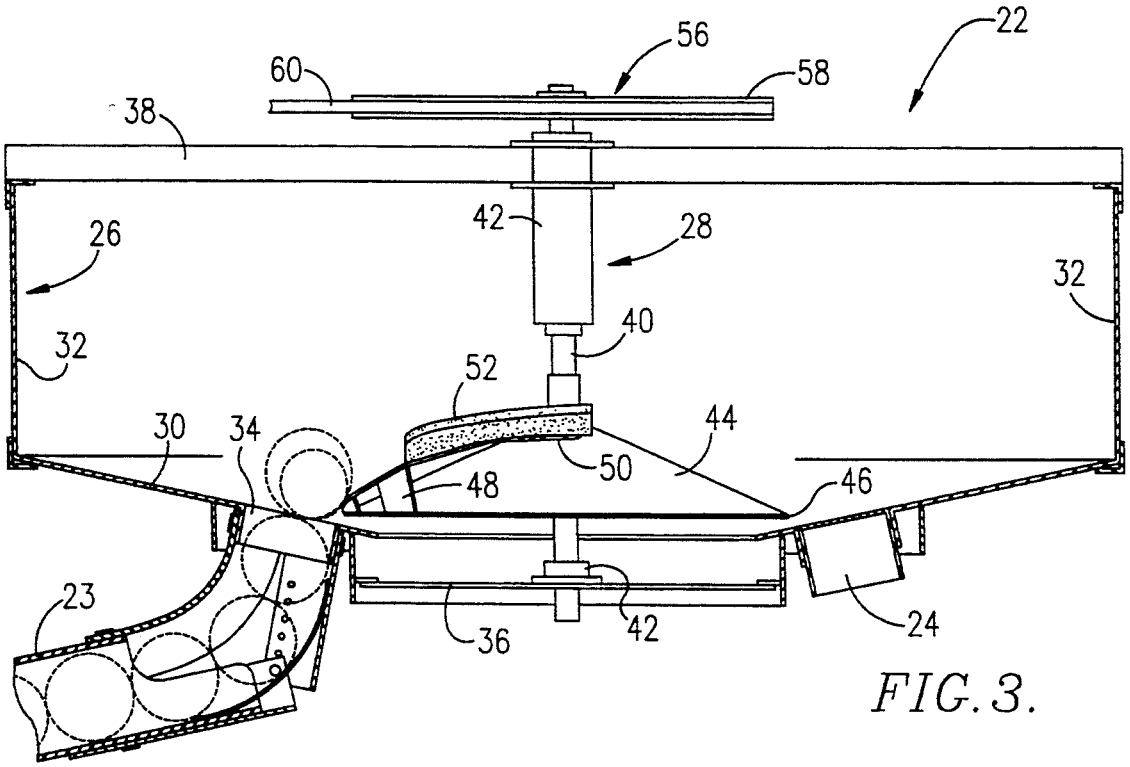
FIG. 3 is a side elevational view, partially in section, of one of the collection boxes and an agitator positioned in the box.

In the preferred embodiment, the two distribution assemblies are substantially the same. Accordingly, only one assembly is illustrated in FIGS. 3–6. Turning first to FIG. 3, the apparatus generally includes a collection box 26 and an agitation means 28 for agitating the balls in the box.

The box 26 includes a floor 30 and a perimeter side wall 32 extending up from the floor to define a space within which balls are collected. The floor is sloped from the side walls 32 downward toward the center of the box, and includes twelve outlet openings 34 formed in a circle around the center of the floor.

The twelve openings 34 correspond to the maximum number of machines capable of being serviced by the particular distribution assembly shown. If it is necessary to service additional machines, the floor 30 must be formed with additional openings, or an additional assembly must be provided. Because only six pitching machines are connected for service by each of the two assemblies of the apparatus, the plugs 24 are used to block the remaining openings.

The top side of the box and the center of the floor are open to receive the agitation means 28. A support member 36 extends across the bottom of the box beneath the open floor, and is secured to the box so that the agitation means may be supported on the member. A pair of spaced support bars 38 are provided across the top of the box parallel to the support member 36, and are secured to the side walls 32 so that the agitation means is supported both from above and below on the box.

Figure 6:
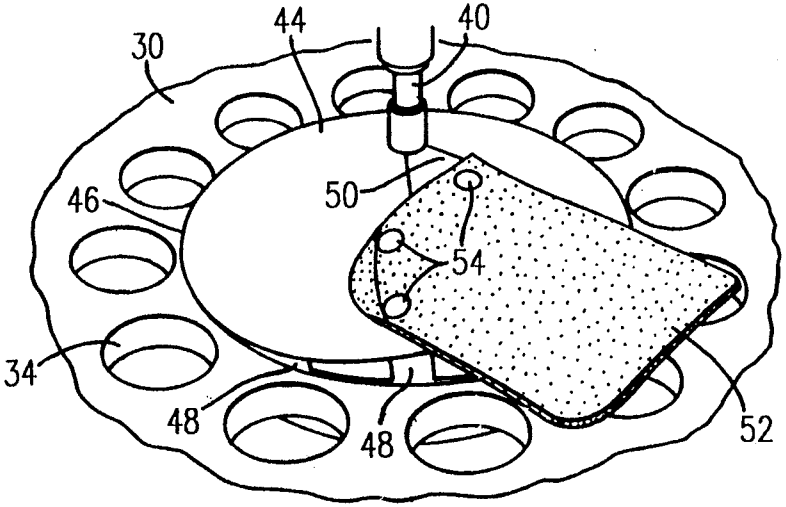
FIG. 6 is a perspective view of the agitator.
Figure 2:
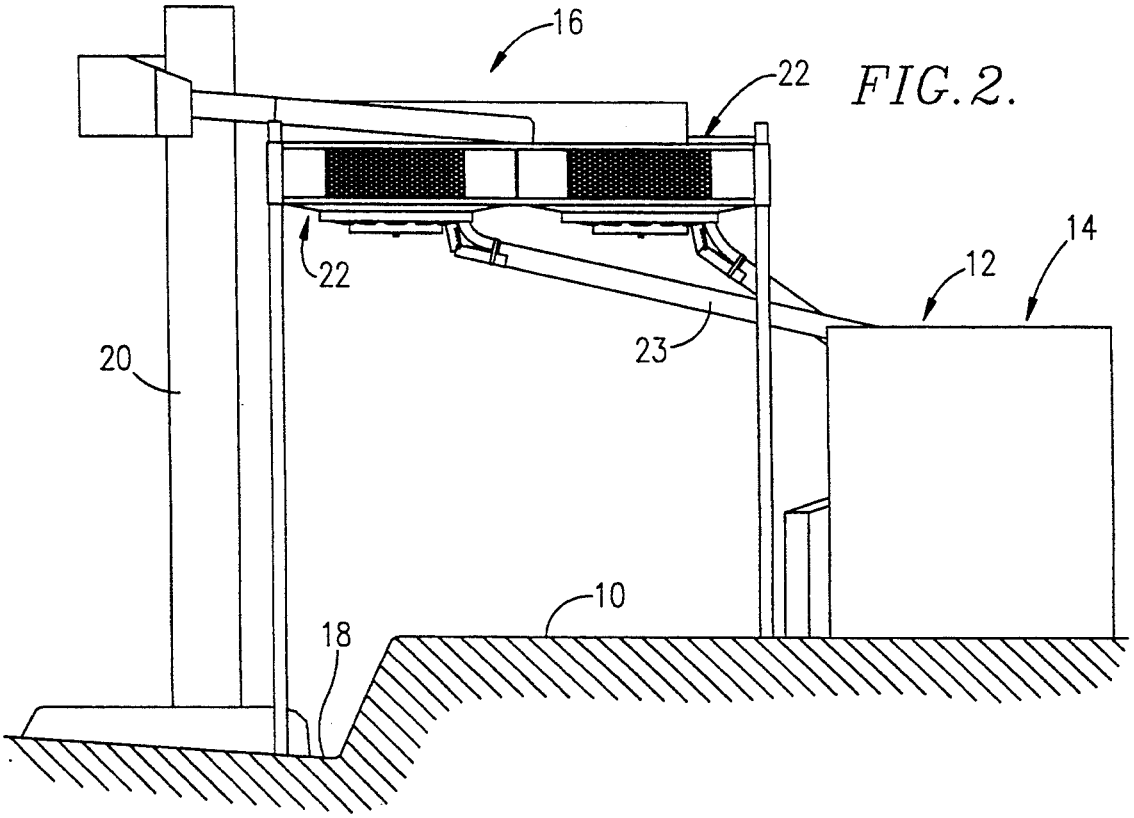
FIG. 2 is a side elevational view of the collection and distribution apparatus, illustrating a separate collection box for softballs and baseballs.
Figure 5:
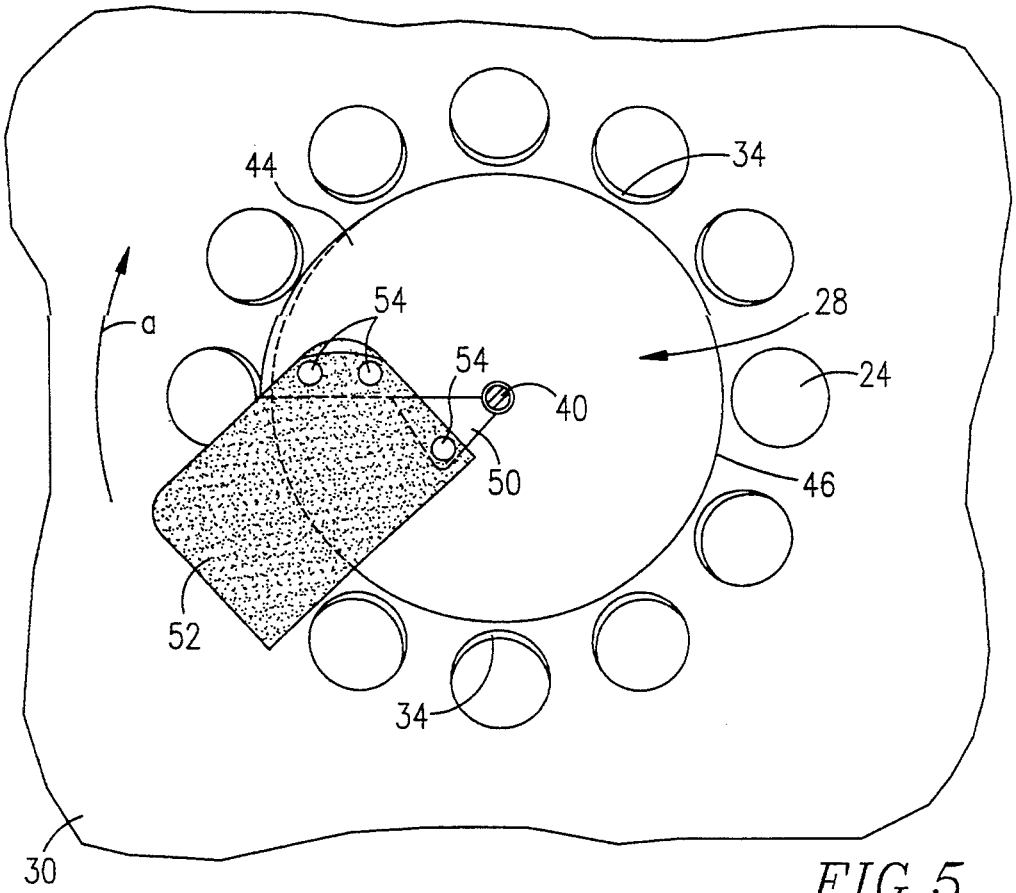
FIG. 5 is a top plan view of the agitator.

The agitation means 28 includes a drive shaft 40 supported by and between the support member 36 and the support bars 38. Bearing assemblies 42 are provided at the upper and lower ends of the shaft 40 to allow rotation of the shaft relative to the box. An agitator 44 is rigidly affixed to the shaft 40 and is formed of a generally circular sheet with a radial slit defining opposed radial edges that are then overlapped to form a helix presenting a sloped upper surface. As shown in FIG. 6, the circumferential edge 46 of the agitator is spiraled, and the shape of the agitator is retained by spaced vertical braces 48 welded between the overlapped portions of the sheet at intervals along the edge 46. Turning to FIG. 5, a lug 50 is welded to the upper radial edge of the agitator adjacent the shaft 40 and extends generally horizontally.

Figure 4:
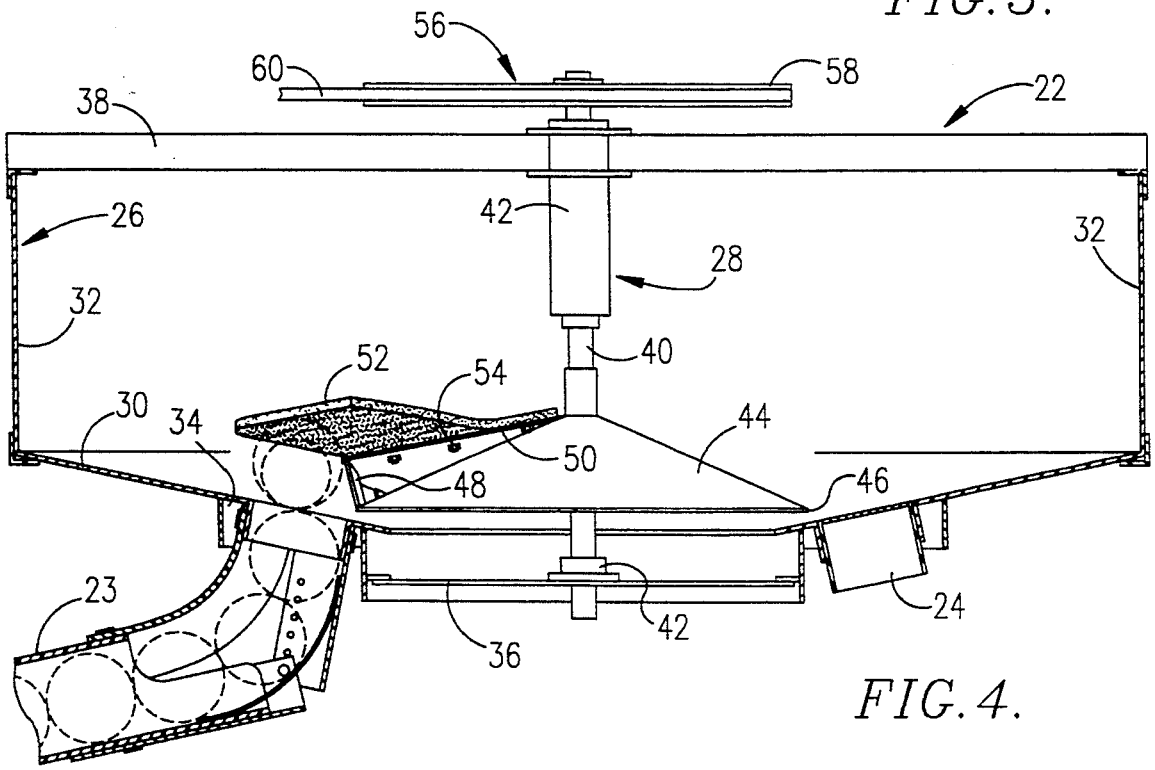
FIG. 4 is a side elevational view similar to FIG. 3, illustrating the agitator in a different position than in FIG. 3.

A flap 52 is secured to the agitator 44 by three fasteners 54, two of which pass directly through the top of the agitator and the third of which is secured to the lug 50. As illustrated in FIG. 6, the agitator 44 supports the flap 52 in a generally horizontal orientation, and positions the flap at a height above the floor less than about the diameter of the smallest balls to be collected and distributed by the apparatus. In addition, as best shown in FIG. 4, the flap 52 is mounted on the agitator so that the flap extends radially beyond both the edge 46 of the agitator and the outlet openings 34 in the floor 30.

The flap is preferably formed of a composition including alternating layers of woven material and rubber, but may be formed of any desired material that is capable of providing suitable flexibility of the flap in a direction transverse to the flap surfaces while at the same time resisting forces parallel to the flap surfaces. As a result of this construction, the flap is not easily pushed circumferentially or inward radially as the flap is moved within the box, but it is able to ride up over balls on the floor of the box as they are engaged and moved toward the outlet openings 34.

As shown in FIG. 3, the leading radial edge of the flap, on the left in the figure, is lower than the trailing edge. This construction allows the flap to plow beneath balls resting on top of the lowermost balls, and to lift the upper balls clear of the lower balls while the lower balls are moved toward the outlet openings.

The agitation means 28 also includes a drive means 56 for rotating the shaft 40 and agitator 44 so that the flap 52 is moved along a circular path extending directly over the outlet openings 34. The drive means 56 includes a pulley 58 connected to the shaft 40, and a belt 60 connected between the pulley and the output shaft of a conventional motor. By providing this construction, it is possible to use the same conventional motor to operate two or more distribution assemblies.

During operation of the apparatus, balls are graded by size and fed to one of the distribution assemblies 22, where they are free to gravitate within the box 26 toward the outlet openings 34 due to the sloped floor 30. Within each assembly 22, the agitator 44 is constantly driven in the direction of arrow a in FIG. 5, to stir the balls within the box. This stirring is achieved both by the helical shape of the agitator which lifts upper layers of balls relative to lower layers, and by the flap 52 which is moved through a circular path over the outlet openings 34 to separate balls in the bottom layer from one another and to relieve the pressure exerted on the lowermost balls from above.

As shown in FIG. 3, the balls in the lowest level within the box roll by gravity against the edge 46 of the agitator 44 and are rocked by the edge to lift the ball relative to the other balls in the box. Also, as illustrated in FIG. 4, the balls along the edge of the agitator 44 are engaged by the flap 52 as the flap is moved over them. As the flap passes, it presses against the balls, rolling them toward the next nearest opening 34. At the same time, the flap loosens the balls from one another and lifts upper balls away from the lower ones so that as each ball enters an outlet opening, it is free to fall into the opening without restriction.

The flap 52 is rigid enough to resist radial and circumferential forces exerted on the flap by the balls so that the balls are not able to force the flap from the circular path over the outlet openings. However, the flap is resilient enough relative to the balls to flex vertically when the flap moves over a ball.

Both baseball and softball sized balls are shown in FIG. 4 adjacent the flap 52. This figure illustrates the preferred construction of the flap, wherein the flap is positioned at a height above the floor slightly less than the diameter of a baseball. By providing this construction, the flap engages either baseballs or softballs and may be used in both of the distribution assemblies.

Although the invention has been described with reference to the preferred embodiment illustrated in the attached drawing figures, it is noted that substitutions may be made and equivalents employed herein without departing from the scope of the invention as recited in the claims.

What is claimed is:

1. An apparatus for use in collecting and distributing balls, the apparatus comprising:

a collection box having a floor and a plurality of outlet openings formed in the floor;

a feeding means for feeding balls of a predetermined diameter to the collection box; and an agitation means for agitating the balls in the box, the agitation means including a flap positioned above the floor by a distance less than about the diameter of the balls, and a support means for supporting the flap in a generally horizontal orientation and for moving the flap along a path extending directly over the openings, the flap being flexible vertically relative to the balls so that the balls roll beneath the flap as it moves over them.

2. An apparatus as recited in claim 1, wherein the box floor is sloped toward the outlet openings.

3. An apparatus as recited in claim 1, wherein the support means includes a central axis about which it is rotatable, the agitation means including a drive means for rotating the support means so that the flap is moved along a circular path over the openings.

4. An apparatus as recited in claim 3, wherein the support means includes an agitator having a circumferential edge and a sloped upper surface on which the flap is secured, the flap extending radially beyond the circumferential edge over the openings.

5. An apparatus as recited in claim 4, wherein the circumferential edge is helical.

6. An apparatus as recited in claim 4, wherein the agitator has a circular plan shape and the outlet openings are disposed beyond the circumferential edge of the agitator.

7. An apparatus as recited in claim 6, wherein the flap extends radially beyond the openings.

8. An apparatus as recited in claim 4, wherein the flap is formed of a piece of material that is rigid enough to resist radial and circumferential forces exerted on the flap so that the balls are not able to force the flap from the path over the outlet openings, the flap material being resilient enough to flex vertically when moved over a ball.

9. An apparatus for use in collecting balls and distributing them to a plurality of pitching machines, the apparatus comprising:

a collection box having a floor and a plurality of outlet openings formed in the floor;

a feeding means for feeding balls of a predetermined diameter to the collection box; and an agitator supported for rotation within the box, the agitator including a radially extending, generally horizontally disposed flap positioned above the floor by a distance less than about the diameter of the balls; and a drive means for rotating the agitator and moving the flap along a circular path extending directly over the openings, the flap being flexible vertically relative to the balls so that the balls roll beneath the flap as it moves over them.

10. An apparatus as recited in claim 9, further comprising plug means for plugging one of the outlet openings to prevent balls from dropping through the plugged opening.

11. An apparatus as recited in claim 9, further comprising delivery tubes and connection means for connecting the tubes between the outlet openings in the box and the pitching machines.

* * * * *